US011053750B2

(12) United States Patent
Anderson et al.

(10) Patent No.: US 11,053,750 B2
(45) Date of Patent: Jul. 6, 2021

(54) DRAG BLOCK FOR A DOWNHOLE TOOL

(71) Applicants: Gary L. Anderson, Humble, TX (US); Christopher David Young, Houston, TX (US); James Doane, Friendswood, TX (US); Guijun Deng, The Woodlands, TX (US)

(72) Inventors: Gary L. Anderson, Humble, TX (US); Christopher David Young, Houston, TX (US); James Doane, Friendswood, TX (US); Guijun Deng, The Woodlands, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 81 days.

(21) Appl. No.: 16/429,454

(22) Filed: Jun. 3, 2019

(65) Prior Publication Data

US 2020/0378196 A1 Dec. 3, 2020

(51) Int. Cl.
*E21B 17/10* (2006.01)
*E21B 23/01* (2006.01)

(52) U.S. Cl.
CPC ..... *E21B 17/1014* (2013.01); *E21B 23/01* (2013.01)

(58) Field of Classification Search
CPC ..... E21B 17/10; E21B 23/01
See application file for complete search history.

(56) References Cited

U.S. PATENT DOCUMENTS

| | | | | |
|---|---|---|---|---|
| 5,623,991 | A | 4/1997 | Jani | |
| 6,073,693 | A | 6/2000 | Aldridge | |
| 6,155,346 | A * | 12/2000 | Aldridge | E21B 23/01 166/216 |
| 6,367,552 | B1 * | 4/2002 | Scott | E21B 17/07 166/242.7 |
| 2010/0101779 | A1 * | 4/2010 | Obrejanu | E21B 23/01 166/216 |
| 2017/0183921 | A1 | 6/2017 | Dockweiler | |

OTHER PUBLICATIONS

International Search Report and Written Opinion for International Application No. PCT/US2020/030375; International Filing Date Apr. 29, 2020; Report dated Aug. 7, 2020 (pp. 1-11).

* cited by examiner

*Primary Examiner* — Caroline N Butcher
(74) *Attorney, Agent, or Firm* — Cantor Colburn LLP

(57) ABSTRACT

A drag block for retaining slips on a tool includes a body having a substantially annular outer surface and a substantially annular inner surface, and a plurality of drag block members resiliently mounted to the substantially annular outer surface. Each of the plurality of drag block members includes a support element and a block element. The support element has a first end fixedly mounted to the substantially annular outer surface and a second, cantilevered end. The drag block is mounted to the second cantilevered end.

20 Claims, 5 Drawing Sheets

DRAG BLOCK FOR A DOWNHOLE TOOL

BACKGROUND

In the resource recovery industry tubulars are introduced into a wellbore to deliver tools to a particular area. For example, packers may be introduced into a wellbore. The packer may be expanded radially outwardly against a casing tubular to create various resource production zones. In some cases, the packer may include slips that anchor to the casing tubular. Slips may be used with other downhole systems such as valves, flow devices and the like.

Often times, a drag block is used to hold slips in position during run in. The drag block may include one or more projections that drag along a casing ID during run in. The drag block may also include slip retaining elements. A typical drag block includes twenty-two parts including the projections, springs that act on the projections, and the slip retaining elements. Constructing drag blocks requires time, experience, and special tools. When multiple drag blocks are required on a tubular, productions delays may ensue. Accordingly, the industry would welcome a simpler drag block that may be installed on a tubular in a timely manner without the need for special tools, or expertise.

SUMMARY

Disclosed is a drag block for retaining slips on a tool including a body having a substantially annular outer surface and a substantially annular inner surface, and a plurality of drag block members resiliently mounted to the substantially annular outer surface. Each of the plurality of drag block members includes a support element and a block element. The support element has a first end fixedly mounted to the substantially annular outer surface and a second, cantilevered end. The drag block is mounted to the second cantilevered end.

Also discloses is a resource exploration and recovery system including a first system and a second system including a one or more tubulars extending into a formation. The one or more tubulars are fluidically connected to the first system. At least one of the one or more tubulars supports a tool. A drag block is mounted about the at least one tubular and operatively connected to the tool. The drag block includes a body having a substantially annular outer surface and a substantially annular inner surface and a plurality of drag block members resiliently mounted to the substantially annular outer surface. Each of the plurality of drag block members includes a support element and a block element. The support element has a first end fixedly mounted to the substantially annular outer surface and a second, cantilevered end. The drag block is mounted to the second cantilevered end.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
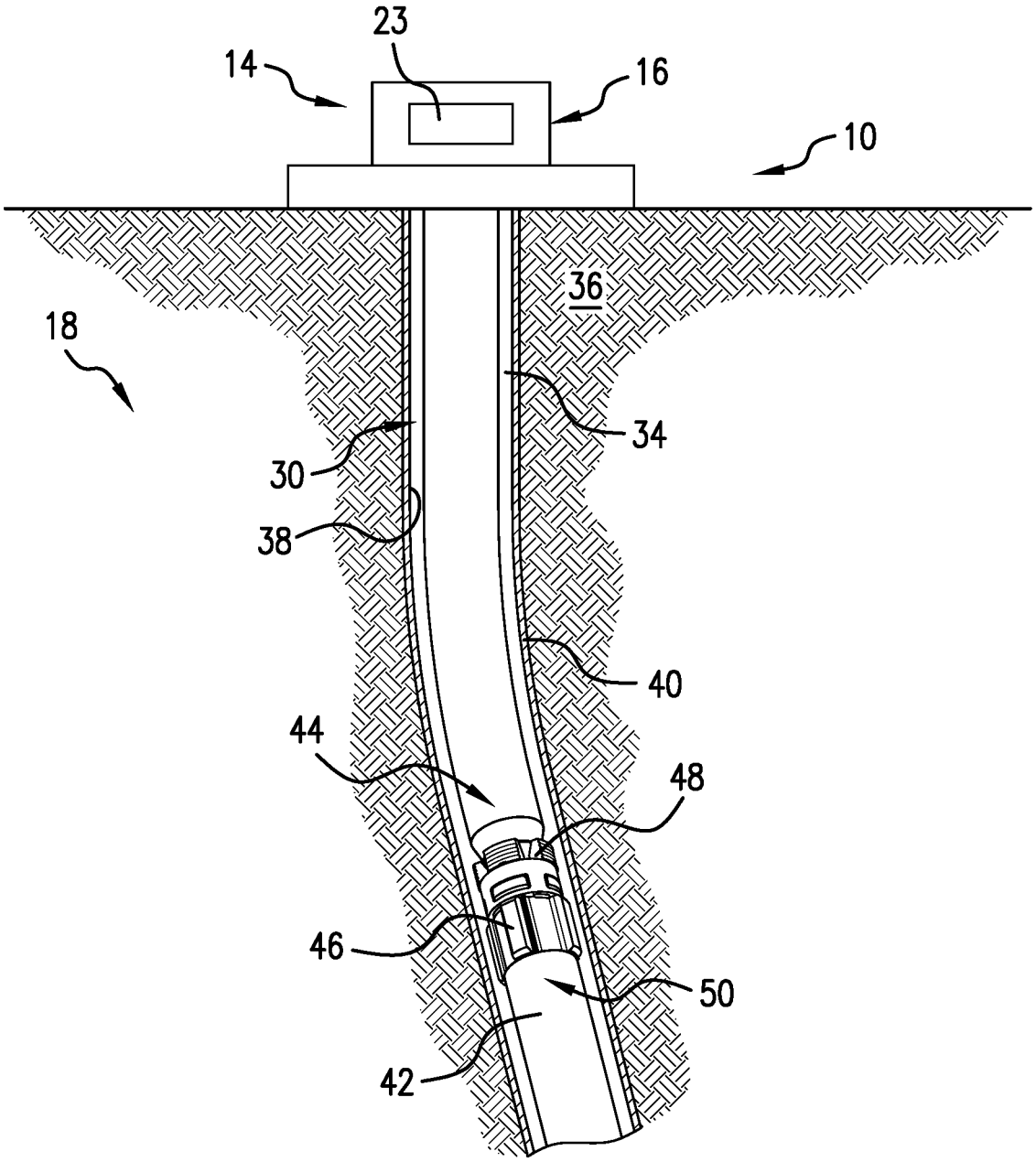
FIG. 1 depicts a resource exploration and recovery system including a tubular supporting a drag block, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Wellbore 34 includes an annular wall 38 defined by a casing tubular 40.

Figure 2:
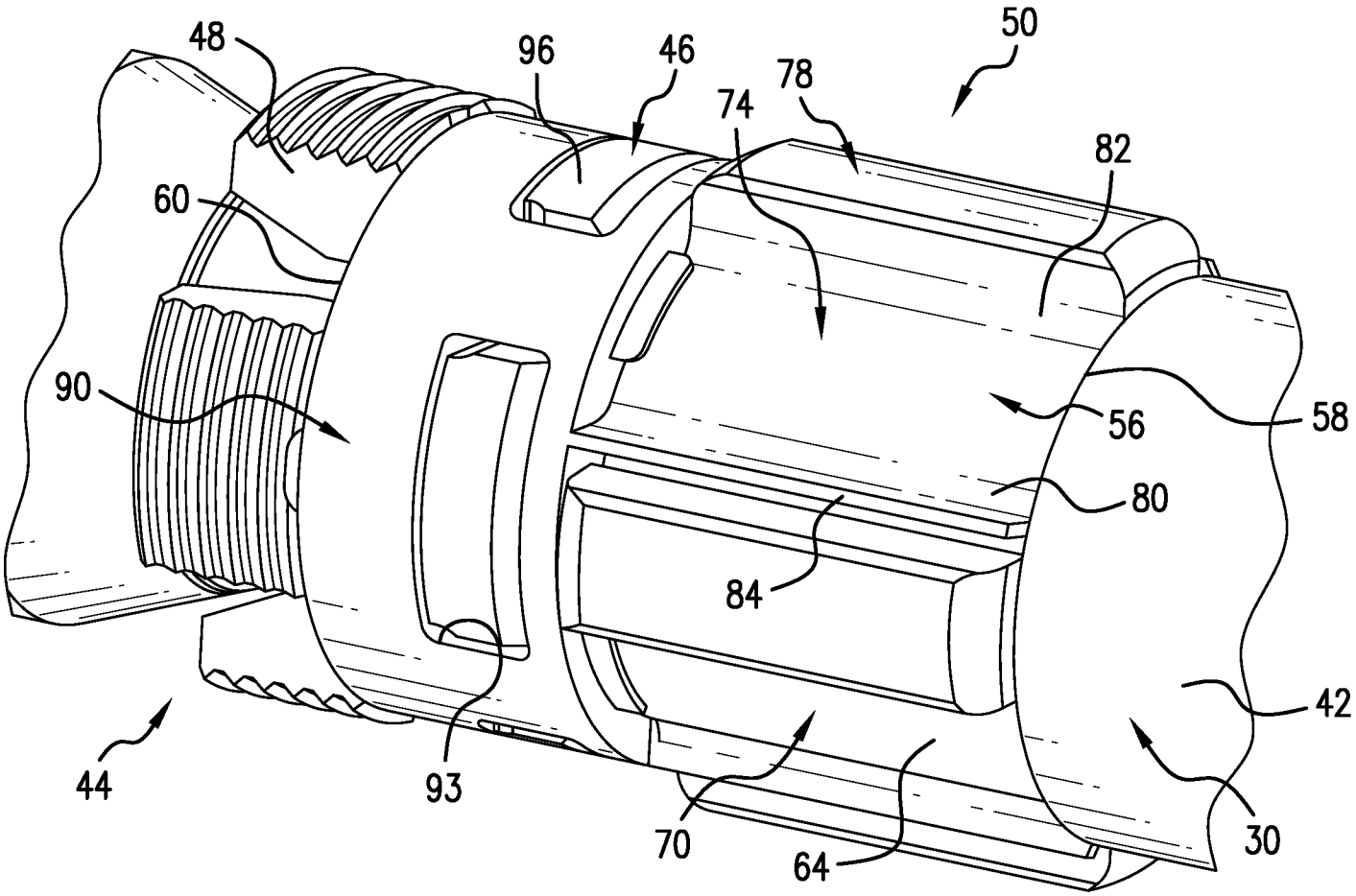
FIG. 2 depicts the drag block of FIG. 1 mounted to a slip assembly, in accordance with an aspect of an exemplary embodiment.

Tubular string 30 may be formed by a series of interconnected discrete tubulars one of which is indicated at 42. Tubular 42 may support a tool 44 such as an anchor or slip assembly 46 including a plurality of slip elements, one of which is indicated at 48, that may be radially outwardly expanded into contact with casing tubular 40. As shown in FIG. 2, each slip element 48 includes a plurality of wickers (not separately labeled) that bite into and lock slip assembly 46 to casing tubular 40. As will be detailed herein, a drag block 50 is mounted about tubular 42 and retained each of the plurality of slip elements 48 in a retained configuration during run in.

Figure 3:
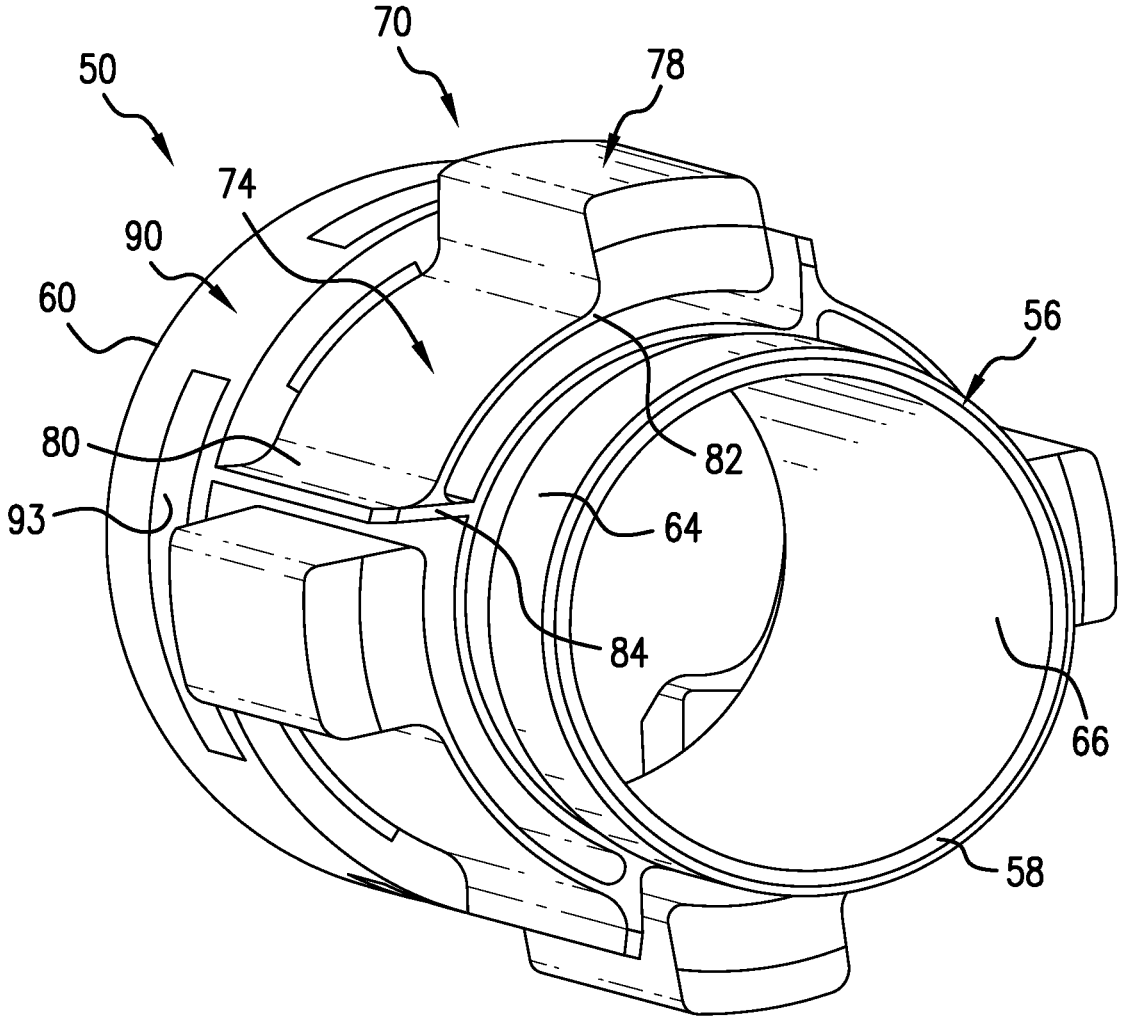
FIG. 3 is a perspective view of the drag block of FIG. 2, in accordance with an aspect of an exemplary embodiment.

Referring to FIG. 3, and with continued reference to FIG. 2, drag block 50, in accordance with an exemplary embodiment, includes a body 56 having a first axial end 58 and a second, opposing axial end 60. Body 56 includes a substantially annular outer surface 64 and a substantially annular inner surface 66. Annular outer surface 64 and annular inner surface 66 may be continuous surfaces. Body 56 supports a plurality of block members 70 that are elastically deformable. Block members 70 engage with casing tubular 40 during run-in and may perform a centering function.

Figure 4:
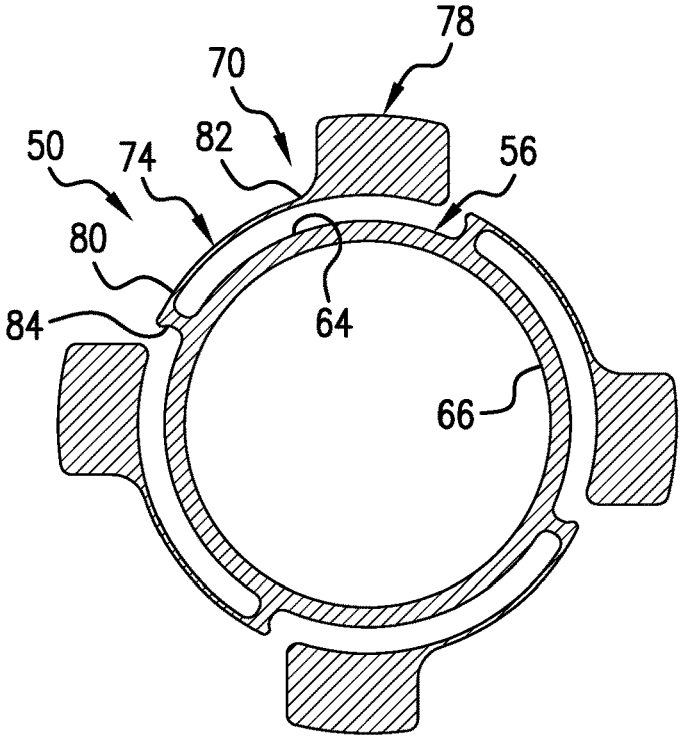
FIG. 4 depicts an axial end view of the drag block of FIG. 2 in a pre-run in configuration, in accordance with another aspect of an exemplary embodiment.
Figure 5:
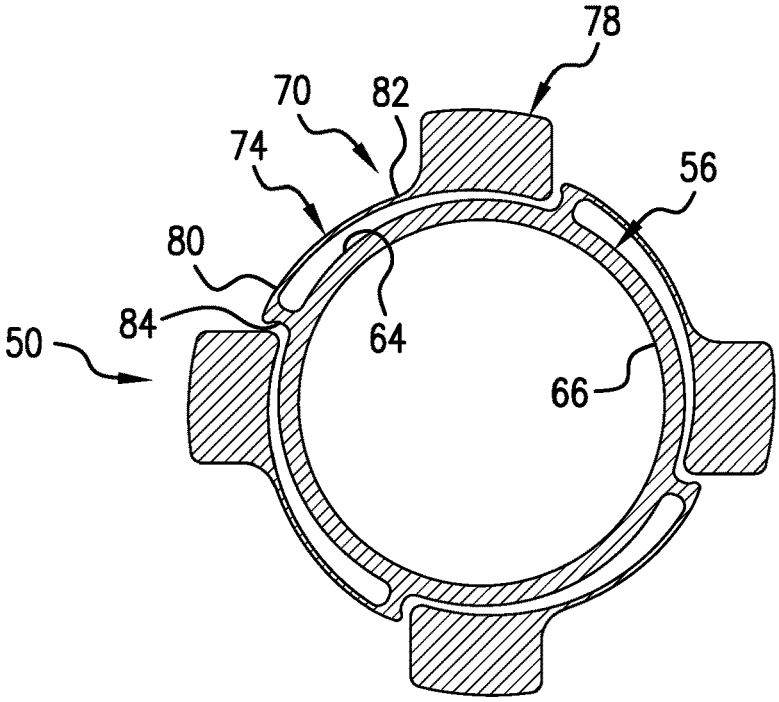
FIG. 5 depicts an axial end view of the drag block of FIG. 4 in a run-in configuration, in accordance with an aspect of an exemplary embodiment.

In an embodiment, each block member 70 includes a support element 74 and a block element 78. Support element 74 includes a first end 80 that is fixedly attached to substantially annular outer surface 64 and a second, cantilevered end 82. Block element 78 is mounted at second end 82 of support element 74. In an exemplary aspect, a support member 84 may project radially outwardly of substantially annular outer surface 64. In one exemplary aspect, support element 74 extends from a mid-portion (not separately labeled) of support member 84 partially circumferentially about body 56. In another exemplary aspect, support element 74 may extend from a terminal end (not separately labeled) of support member 84 such as shown in FIG. 4. Block members 70 may elastically deflect inwardly such as shown in FIG. 5 to maintain tool 44 substantially centered in casing tubular 40.

In accordance with an exemplary aspect, second axial end 60 includes a slip ring 90 having a plurality of slip windows 93. Slip windows 93 receive a portion 96 of a corresponding one of the plurality of slip elements 48. Slip ring 90 retains the plurality of slip elements 48 in a non-deployed state during run-in. Drag block 50 may be shifted axially away from tool 44 allowing slip 46 to be deployed such that the plurality of slip elements 48 expand radially outwardly and bit into casing tubular 40.

Figure 6:
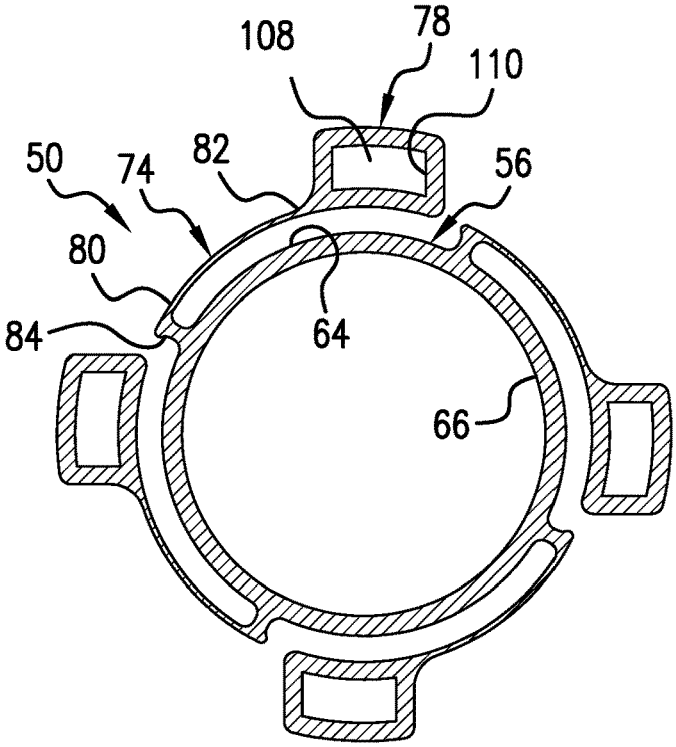
FIG. 6 depicts an axial, cross-sectional view of a drag block, in accordance with another aspect of an exemplary embodiment.
Figure 7:
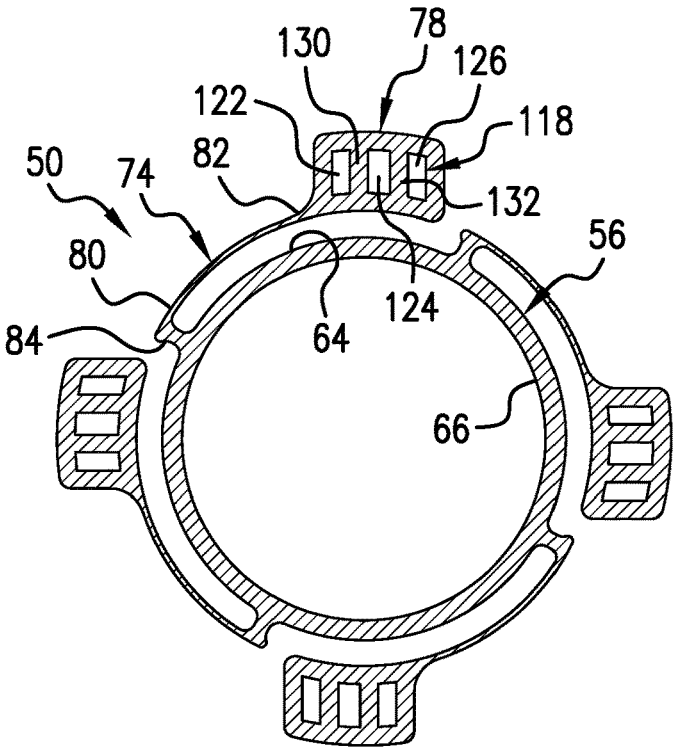
FIG. 7 depicts an axial, cross-sectional view of a drag block, in accordance with another aspect of an exemplary embodiment.

In accordance with an exemplary aspect, drag block 50 is a single unitary piece. That is, body 56, drag block member 70, support members 84, and slip ring 90 may all be all integrally formed. In an embodiment, drag block 50 may be formed using an additive manufacturing process. In another embodiment, drag block 50 may be cast or formed by joining the various components by, for example, welding. In yet another exemplary aspect depicted in FIG. 6, wherein like reference numbers represent corresponding parts in the respective views, each block element 78 may include a void 108 defined by a continuous wall 110. Void 108 reduced an overall amount of material required to form drag block 50 without detracting from structural integrity. In FIG. 7, wherein like reference numbers represent corresponding parts in the respective views, each drag block 78 may include an internal void 118 including multiple spaces 122, 124, and 126 defined by first and second supports 130 and 132. With this arrangement, material needed to form drag block 50 may be reduced with first and second supports 130 and 132 providing additional structural integrity.

Drag block 50 may be formed from a variety of materials including steel, stainless steel, nickel alloys and the like. Further, it should be appreciated that support element 74 may be tailored to desired applications. That is, length and thickness of support element 74 may be varied in order to achieve a desired degree of deflection and a desired force required to deflect block elements 78. Further, the number of drag block members may vary. Thus, drag block may be constructed off site and installed at first system 14 with little to no tools and with exceptional ease.

Set forth below are some embodiments of the foregoing disclosure:

Embodiment 1

A drag block for retaining slips on a tool comprising: a body having a substantially annular outer surface and a substantially annular inner surface; and a plurality of drag block members resiliently mounted to the substantially annular outer surface, each of the plurality of drag block members including a support element and a block element, the support element having a first end fixedly mounted to the substantially annular outer surface and a second, cantilevered end, the drag block being mounted to the second cantilevered end.

Embodiment 2

The drag block according to any prior embodiment, further comprising: a support member projecting radially outwardly of the substantially annular outer surface, the first end of the support element extending from the support member.

Embodiment 3

The drag block according to any prior embodiment, wherein the block element is integrally formed with the support element.

Embodiment 4

The drag block according to any prior embodiment, wherein the support element is integrally formed with the body.

Embodiment 5

The drag block according to any prior embodiment, wherein the substantially annular inner surface comprises a continuous surface.

Embodiment 6

The drag block according to any prior embodiment, wherein the support element is elastically deformable.

Embodiment 7

The drag block according to any prior embodiment, wherein the body includes a first axial end and a second opposing axial end, the second axial end supporting a slip ring.

Embodiment 8

The drag block according to any prior embodiment, wherein the slip ring includes a plurality of slip windows.

Embodiment 9

The drag block according to any prior embodiment, wherein the slip ring is integrally formed with the body.

Embodiment 10

A resource exploration and recovery system comprising: a first system, a second system including a one or more tubulars extending into a formation, the one or more tubulars being fluidically connected to the first system, at least one of the one or more tubulars supports a tool; and a drag block mounted about the at least one tubular and operatively connected to the tool, the drag block including: a body having a substantially annular outer surface and a substantially annular inner surface; and a plurality of drag block members resiliently mounted to the substantially annular outer surface, each of the plurality of drag block members including a support element and a block element, the support element having a first end fixedly mounted to the substantially annular outer surface and a second, cantilevered end, the drag block being mounted to the second cantilevered end.

Embodiment 11

The resource exploration and recovery system according to any prior embodiment, further comprising: a support member projecting radially outwardly of the substantially annular outer surface, the first end of the support element extending from the support member.

Embodiment 12

The resource exploration and recovery system according to any prior embodiment, Wherein the block element is integrally formed with the support element.

Embodiment 13

The resource exploration and recovery system according to any prior embodiment, wherein the support element is integrally formed with the body.

Embodiment 14

The resource exploration and recovery system according to any prior embodiment, wherein the substantially annular inner surface comprises a continuous surface.

Embodiment 15

The resource exploration and recovery system according to any prior embodiment, wherein the support element is elastically deformable.

Embodiment 16

The resource exploration and recovery system wherein the tool comprises a slip including a plurality of slip fingers.

Embodiment 17

The resource exploration and recovery system according to any prior embodiment, wherein the body includes a first axial end and a second opposing axial end, the second axial end supporting a slip ring.

Embodiment 18

The resource exploration and recovery system according to any prior embodiment, wherein the slip ring includes a plurality of slip windows, each of the slip windows receiving a portion of a corresponding one of the plurality of slip fingers.

Embodiment 19

The resource exploration and recovery system according to any prior embodiment, wherein the slip ring is integrally formed with the body.

Embodiment 20

The resource exploration and recovery system according to any prior embodiment, wherein the drag block is formed from one of steel, and a nickel alloy.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A drag block for retaining slips on a tool comprising:

a body having a substantially annular outer surface and a substantially annular inner surface; and a plurality of drag block members resiliently mounted to the substantially annular outer surface, each of the plurality of drag block members including a support element and a block element, the support element having a first end immovably mounted to the substantially annular outer surface and a second, cantilevered end, the drag block being mounted to the second cantilevered end.

2. The drag block according to claim 1, further comprising: a support member projecting radially outwardly of the substantially annular outer surface, the first end of the support element extending from the support member.

3. The drag block according to claim 1, wherein the block element integrally formed with the support element.

4. The drag block according to claim 3, wherein the support element is integrally formed with the body.

5. The drag block according to claim 1, wherein the substantially annular inner surface comprises a continuous surface.

6. The drag block according to claim 1, wherein the support element is elastically deformable.

7. The drag block according to claim 1, wherein the body includes a first axial end and a second opposing axial end, the second axial end supporting a slip ring.

8. The drag block according to claim 7, wherein the slip ring includes a plurality of slip windows.

9. The drag block according to claim 7, wherein the slip ring is integrally formed with the body.

10. A resource exploration and recovery system comprising:

a first system;

a second system including a one or more tubulars extending into a formation, the one or more tubulars being fluidically connected to the first system, at least one of the one or more tubulars supports a tool; and a drag block mounted about the at least one tubular and operatively connected to the tool, the drag block including:

a body having a substantially annular outer surface and a substantially annular inner surface; and a plurality of drag block members resiliently mounted to the substantially annular outer surface, each of the plurality of drag block members including a support element and a block element, the support element having a first end immovably fixedly mounted to the substantially annular outer surface and a second, cantilevered end, the drag block being mounted to the second cantilevered end.

11. The resource exploration and recovery system according to claim 10, further comprising: a support member projecting radially outwardly of the substantially annular outer surface, the first end of the support element extending from the support member.

12. The resource exploration and recovery system according to claim 10, wherein the block element is integrally formed with the support element.

13. The resource exploration and recovery system according to claim 12, wherein the support element is integrally formed with the body.

14. The resource exploration and recovery system according to claim 10, wherein the substantially annular inner surface comprises a continuous surface.

15. The resource exploration and recovery system according to claim 10, wherein the support element is elastically deformable.

16. The resource exploration and recovery system according to claim 10, wherein the tool comprises a slip including a plurality of slip fingers.

17. The resource exploration and recovery system according to claim 16, wherein the body includes a first axial end and a second opposing axial end, the second axial end supporting a slip ring.

18. The resource exploration and recovery system according to claim 17, wherein the slip ring includes a plurality of slip windows, each of the slip windows receiving a portion of a corresponding one of the plurality of slip fingers.

19. The resource exploration and recovery system according to claim 17, slip ring is integrally formed with the body.

20. The resource exploration and recovery system according to claim 10, wherein the drag block is formed from one of steel, and a nickel alloy.

* * * * *